US006637959B1

(12) United States Patent
Baitz et al.

(10) Patent No.: US 6,637,959 B1
(45) Date of Patent: Oct. 28, 2003

(54) PRINTING DEVICE WITH MEANS FOR CONVEYING PAPER

(75) Inventors: Günter Baitz, Berlin (DE); Wilfried Dobring, Berlin (DE); Wolfgang Malke, Berlin (DE)

(73) Assignee: Wincor Nixdorf GmbH & Co. KG, Paderborn (DE)

( * ) Notice: Subject to any disclaimer, the term of this patent is extended or adjusted under 35 U.S.C. 154(b) by 0 days.

(21) Appl. No.: 09/913,989

(22) PCT Filed: Mar. 11, 2000

(86) PCT No.: PCT/DE00/00766

§ 371 (c)(1),
(2), (4) Date: Aug. 21, 2001

(87) PCT Pub. No.: WO00/56551

PCT Pub. Date: Sep. 28, 2000

(30) Foreign Application Priority Data

Mar. 18, 1999 (DE) ..... 199 12 255

(51) Int. Cl.[7] ..... B41J 11/00

(52) U.S. Cl. ..... 400/613; 400/614; 400/634; 400/611

(58) Field of Search ..... 400/613, 614, 400/614.1, 611, 615, 693, 218, 693.1, 634, 636; 347/29, 30, 31, 32, 33

(56) References Cited

U.S. PATENT DOCUMENTS 4,929,099 A * 5/1990 Graham et al. ..... 400/76
5,320,437 A * 6/1994 Malke et al. ..... 400/605
5,668,581 A 9/1997 Tsuji et al. ..... 347/37
5,731,829 A 3/1998 Saito et al. ..... 347/104
5,800,076 A 9/1998 Umeda ..... 400/645.3
5,993,093 A * 11/1999 Schoennauer et al. ..... 400/621
6,004,053 A * 12/1999 Petteruti et al. ..... 400/693
6,491,459 B2 * 12/2002 Hosomi ..... 400/613

FOREIGN PATENT DOCUMENTS

DE 2 309 684 9/1974 ..... B41J/3/18
JP 4-366639 A 12/1992 ..... B41J/2/01
WO WO 91/13765 9/1991 ..... B41J/29/02

* cited by examiner

*Primary Examiner*—Andrew H. Hirshfeld
*Assistant Examiner*—Dave A. Ghatt
(74) *Attorney, Agent, or Firm*—McCormick, Paulding & Huber LLP

(57) ABSTRACT

Printing device with means for conveying paper A printing device (10) comprises a lower part (12) and an upper part (14) that is mounted on said lower part (12) such that it can pivot about a pivot axis (16). A print head (18) and a holding trough. (62) for a recording medium supply roll (64) are arranged in the lower part (12) , and a conveying device (24, 30) for a recording medium (66), and a print backing support (36) spatially associated with the print head (18) are arranged in the upper part (14). The upper part (14) has two side walls (42) which laterally enclose a recording medium supply roll (64) put into the holding trough (62). The invention is characterized in that the print backing support (36) is planar in the printing area (70) of the print head (18), the conveying device comprises a pair of conveyor rollers (24) that are aligned parallel with the print backing support (36) and can be driven by a motor, and a tautening device (30) for the recording medium (66), and in that the pivot axis (16) is located underneath the print backing support (36).

12 Claims, 3 Drawing Sheets

PRINTING DEVICE WITH MEANS FOR CONVEYING PAPER

Figure 1:
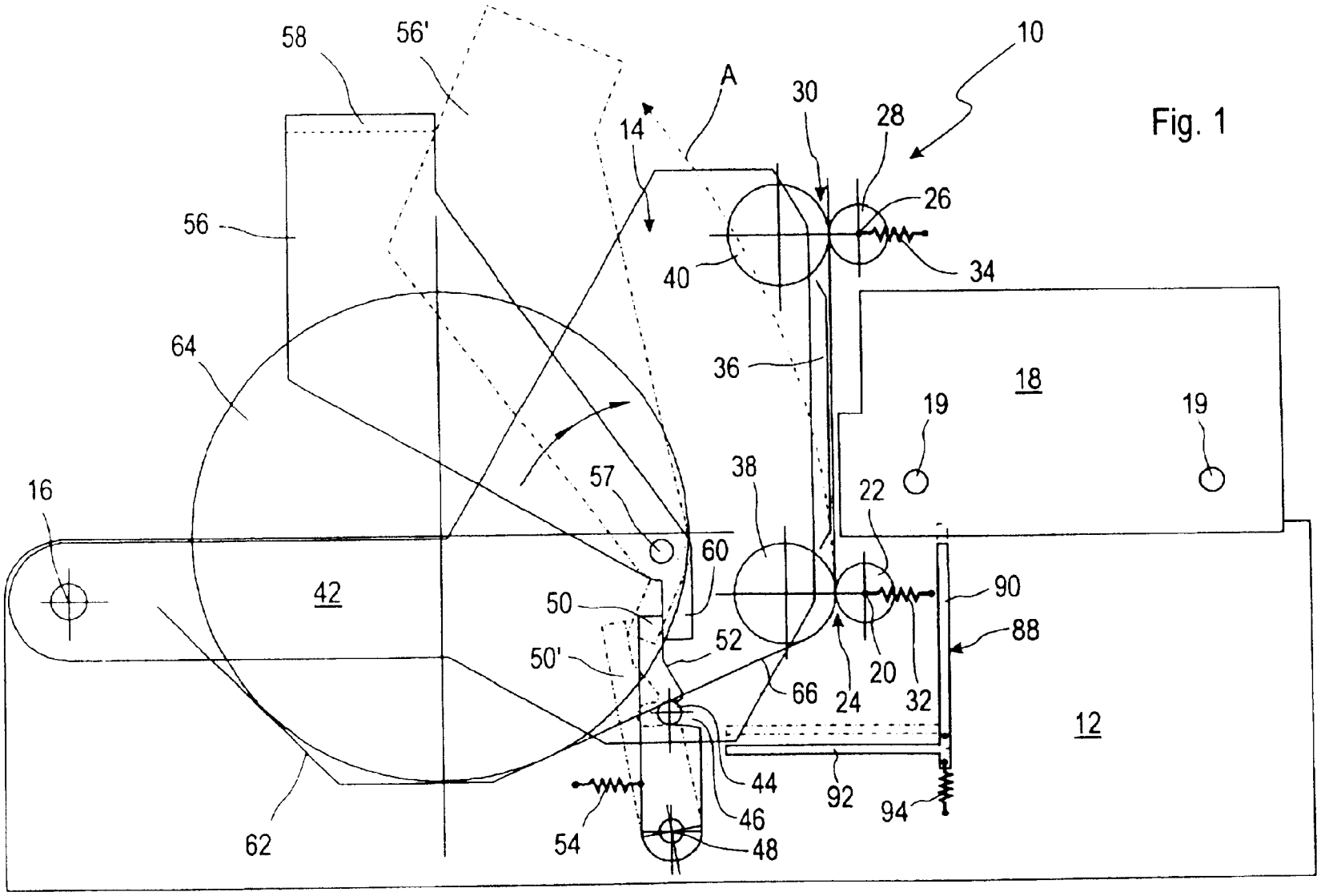

The invention relates to a printing device according to the preamble of claim 1.

A printing device of the type mentioned is disclosed by DE 23 09 684 A1. This describes an electrographic printing device having an electrode comb which extends over the width of the line of print, said device comprising a lower part and an upper part mounted on the latter such that it can pivot about a pivot axis. The electrode comb and a holder for a recording medium supply roll are arranged in the lower part, and a conveying device, designed as a printing roller, for a recording medium is arranged in the upper part. The electrode comb is associated spatially with the printing roller, the individual electrodes being sprung against the printing roller. The printing roller therefore forms a print backing support and, in interaction with the electrodes, a recording medium conveying device. The upper part has two side walls which laterally enclose a recording medium supply roll put into the holder.

The known arrangement has the advantage that a recording medium supply roll can be put in particularly simply. The arrangement may also be highly suitable for a printing device which, as a print head, has an electrode comb which touches the recording medium only at a line. However, if a print head is to be used which opposes the recording medium flatly and at a distance, then this arrangement cannot be used.

WO 91 13765 A1 describes a printer which likewise comprises a lower part and an upper part that is mounted on the latter such that it can pivot about a pivot axis. A print head is arranged in the lower part, and a printing bar and a holder for a recording medium supply roll are arranged in the upper part. Provided as a conveying device for a recording medium are two pairs of conveyor rollers of which one, as viewed in the conveying direction of the recording medium, is located upstream of the printing bar and is driven at the same time as a second pair of conveying rollers, which are arranged downstream of the printing bar. It is seen as a drawback that, because of the arrangement of the recording medium supply roll in the upper part, the recording medium has to be led through a slot and around the upper conveying roller located upstream of the printing bar and also around the printing bar itself. Replacing a recording medium supply roll is therefore difficult and time-consuming.

It is therefore an object of the invention to develop a printing device of the type mentioned to the effect that a print head can be used which opposes the recording medium at a distance and whose printing elements extend at least over the width of a line of print.

For a printing device according to the preamble of claim 1, the object is achieved by the defining features of claim 1.

According to the invention, the print backing support is planar in the printing area of a serial-character or serial-column print head that can be displaced in the direction of a line of print, the conveying device comprises a pair of conveyor rollers that are aligned parallel to the printing area and can be driven by a motor, and a tautening device for the recording medium and, as viewed in the direction of a line of print, a parking area for the print head is arranged beside the printing area.

The planar configuration of the print backing support ensures that the distance to the recording medium is the same for all printing elements. The print backing support can be designed as a simple supporting plate in the case of the print head which operates without contact but, when an impact print head is used, must be designed as a printing bar. A combination, described further below, of a pair of conveyor rollers arranged on one side of the print backing support and a tautening device arranged on the other side ensures that the recording medium is always tautly tensioned in the area of the print backing support.

The print head is preferably an ink jet print head which can be moved parallel to the print backing support in the direction of a line of print and which can print one or else a number of lines of print simultaneously.

According to a development of the invention, good tensioning of the recording medium in the area of the print backing support is achieved by a pair of conveyor rollers, as viewed in the conveying direction of the recording medium, being arranged downstream of the print backing support, and a recording medium brake formed of a material with a high coefficient of friction being arranged upstream of the print backing support. In this case, the first pair of conveyor rollers pulls the recording medium held back by the recording medium brake past the print backing support. Here, the recording medium brake can consist of an elastically compressible plastic strip with a high coefficient of friction, which is supported on the print backing support.

According to an alternative development of the invention, the tensioning of the recording medium in the area of the print backing support is achieved by a first pair of conveyor rollers, as viewed in the conveying direction of the recording medium, being arranged upstream of the print backing support, and a second pair of conveying rollers, driven at the same time as the first pair of conveyor rollers, being arranged downstream of the print backing support, the second pair of conveyor rollers being driven at a slightly higher circumferential speed than the first pair of conveyor rollers and having a coefficient of friction which is slightly lower than said first pair, so that the recording medium advance step is determined by the first pair of conveyor rollers.

According to a preferred embodiment of the subject of the invention, the pair of conveyor rollers or else the first and second pairs of conveyor rollers are formed by a driven roller which is mounted in the upper part and acts on the rear of the recording medium, and a backing roller which is mounted in the lower part, is acted on with the force of a spring in the direction of the driven roller, acts on the recording side of the recording medium and runs freely. The fact that the driven rollers act on the rear of the recording medium means that smearing of the still fresh imprint is avoided. The backing rollers are carried along by the recording medium as it is advanced, that is to say moved together with the latter without slip. This reliably avoids smearing of the imprint.

The arrangement of the pivot axis of the upper part at the same height as a center line passing through the first backing roller and the first driven roller, or underneath said line, ensures that when the upper part is pivoted into its open position, the pair of conveyor rollers and the tautening device are already open after sweeping over a minimum pivoting angle, that is to say the recording medium is not carried along with it as it is pivoted.

According to a preferred embodiment of the invention, at least one latching lever provided with a claw is pivotably mounted on the lower part, and a locking pin is arranged on that side wall of the upper part which is adjacent to the latching lever. Of course, the converse arrangement is also possible. The important factor is that the two locking elements are designed to be complementary to each other.

According to an advantageous development of the subject of the invention, a two-armed unlocking lever is pivotably mounted on the side wall adjacent to the latching lever, on the side of the upper part that is remote from the pivot axis, one arm of said unlocking lever being intended to engage on the at least one latching lever with the effect of unlocking the complementary locking elements.

It is particularly advantageous if the at least one latching lever can be moved into the unlocking position only when the print head is in the parking area or an acceleration area that is located in front of the printing area, that is to say outside the printing area. As a result, during the replacement of the recording medium supply roll, the sensitive mouthpiece of the print head is protected against unauthorized contact, and the hands of the operating staff are protected against soiling.

In order to make manual displacement of the print head impossible when the printer is switched off, the print head is additionally blocked in the parking area or the acceleration area if the upper part is located outside the printing position.

In order to reduce still further the risk of smearing the still fresh ink, according to a preferred development of the invention, the backing running roller that is located downstream of the print head in the conveying direction, that is to say at least the backing roller of the pair of conveyor rollers or of the second pair of conveyor rollers, has a surface structure which cannot be wetted by printing ink and/or consists of a material which cannot be wetted by printing ink.

Figure 2:
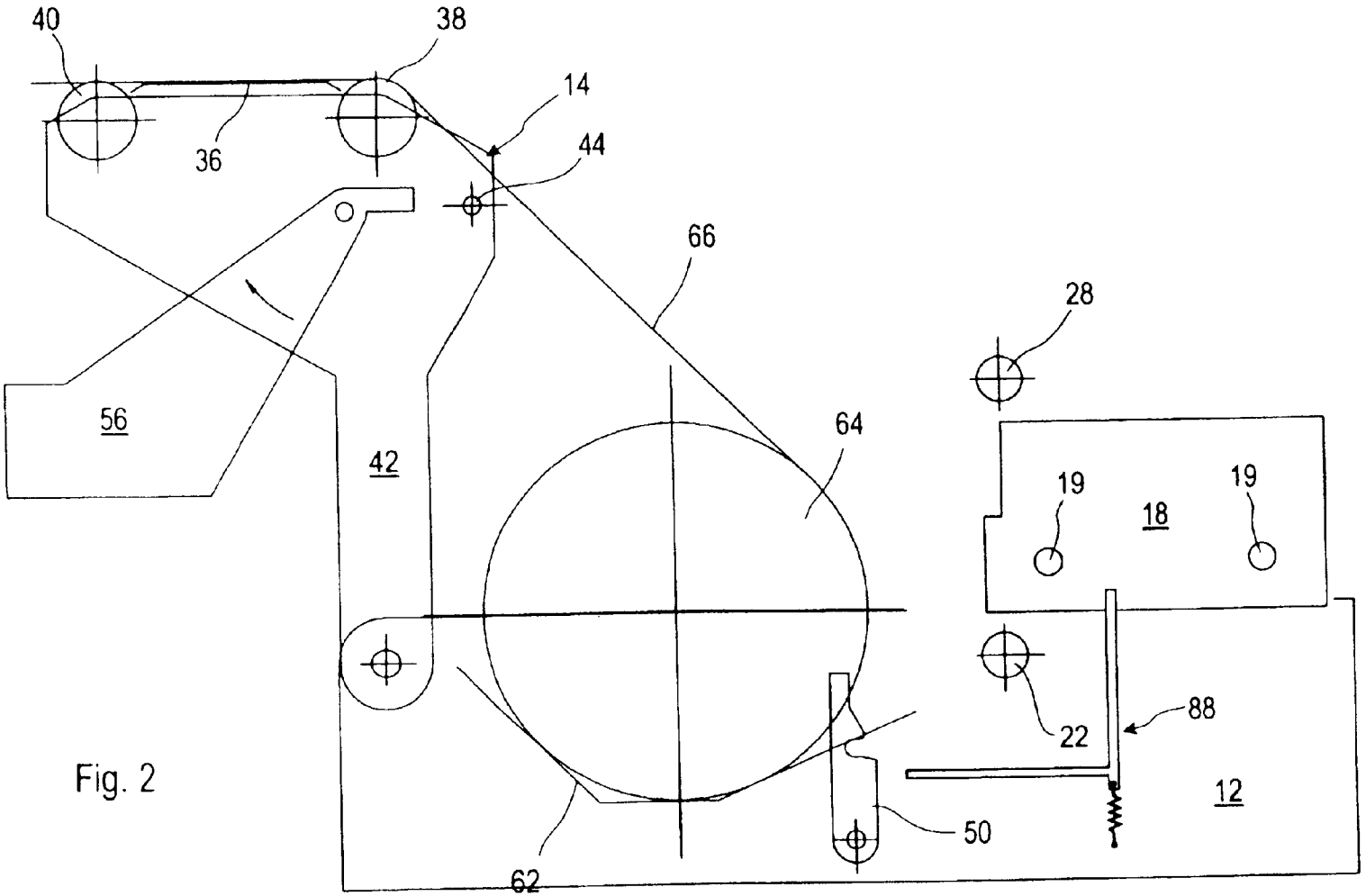
Figure 3:
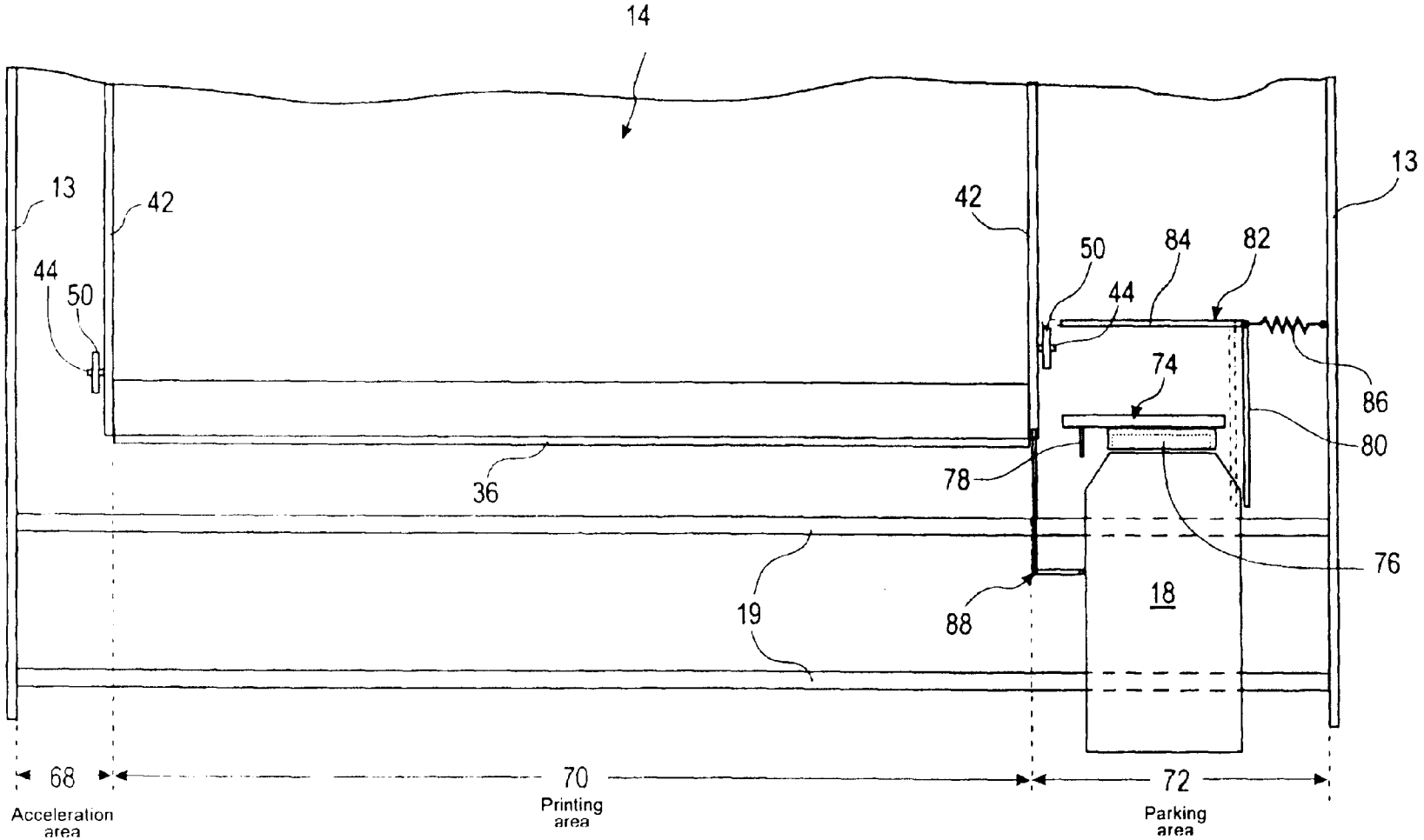

Further features and advantages of the invention emerge from the following description of an exemplary embodiment, which will be explained by using the appended drawing, in which:

FIG. 1 shows a schematic side view of a printing device with the upper part closed, FIG. 2 shows a schematic side view of the printing device with the upper part folded up, FIG. 3 shows the printing device in a schematic plan view.

In FIG. 1, a printing device is designated generally by 10. It comprises a lower part 12 with side cheeks 13 and an upper part 14. The latter is held such that it can be pivoted about a pivot axis 16 in the rear area of the lower part 12, as the arrow A shows.

An ink jet print head 18 is mounted on the lower part 12 such that it can be displaced at right angles to the plane of the drawing on guide rails 19 which are held in the side cheeks 13. Arranged underneath the ink jet print head 18 is a first backing roller 22, which can rotate freely on a first shaft 20, belonging to a first pair of conveyor rollers 24, and arranged above the ink jet print head 18 is a second backing roller 28, which can rotate freely on a second shaft 26, belonging to a second pair of conveyor rollers 30. The two ends of the shafts 20, 26, which extend parallel to the displacement direction of the ink jet print head 18, are resiliently prestressed in the direction of the upper part 14 by a compression spring 32 and 34, respectively (only one compression spring can be seen in each case).

Fixed to the upper part 14, opposite the ink jet print head 18, is a print backing support 36 which is planar in the area of the ink jet print head 18. Arranged underneath the print backing support 36 is a first driven roller 38 of the first pair of conveyor rollers 24, and arranged above the ink jet print head 18 is a second driven roller 40 of the second pair of conveyor rollers 30. The first and the second driven roller 38, 40 are driven by a drive motor which is common to both, arranged in the lower part 12 but not illustrated. The second driven roller 40 has a slightly greater circumference than the first driven roller 38. The print backing support 36 and the first and the second driven roller 38, 40 are held in two side walls 42 that are aligned parallel to each other, the print backing support 36 projecting slightly beyond the driven rollers 38, 40 in the direction of the print head 18, in order that a recording medium 66 rests fully on said print backing support 36. The pivot axis 16 of the upper part 14 is located at the same height as a center line 25 that passes through the first backing roller 22 and the first driven roller 38. It can also be located underneath said line. This means that when the upper part 14 is pivoted into its open position, the first pair of conveyor rollers 24 and the tautening device—the second pair of conveyor rollers 30 in the exemplary embodiment illustrated—are already open after sweeping over a minimum pivoting angle in the direction of the arrow A, that is to say the recording medium 66 is not carried along as the upper part 14 is pivoted. Conversely, when pivoting the upper part 14 back into its printing position, the recording medium 66 is first of all clamped in the first pair of conveyor rollers 24. If the recording medium 66 is tautened manually during the further pivoting of the upper part 14 into the printing position, then the tension is maintained when the second pair of conveyor rollers 30 also clamps the recording medium 66 in.

From each side wall 42, a locking pin 44 protrudes perpendicularly outward. In the position of the upper part 14 that is shown in FIG. 1, the locking pin 44 engages in a claw 46, which is incorporated into one flank of a latching lever 50 that can be pivoted about a pivot pin 48. Above the claw 46, the latching lever 50 tapers to form an insertion bevel 52 for the locking pin 44. The latching lever 50 is acted on in the direction of its locking position, illustrated by continuous lines, with the force of a locking spring 54.

On the side walls 42 of the upper part 14, in each case a two-armed unlocking lever 56 is mounted such that it can be pivoted about a second pivot axis 57 that passes perpendicularly through the side walls 42.

The upwardly projecting arms of the unlocking levers 56 are connected to each other by a handle 58, so that the unlocking lever arrangement 56, 58 embraces the upper part 14 in a U shape. The free arm 60 of each locking lever 56, in its rest position illustrated by continuous lines, rests on the flank of the latching lever 50, into which the claw 46 is also incorporated.

Arranged in the lower part 12 of the printer 10, between the side walls 42 of the upper part 14 and close to the pivot axis 16, is an upwardly open holding trough 62 for a recording medium supply roll 64. The end of the recording medium 66 running away from the underside of the recording medium supply roll 64 is led from below around the first and the second pair of conveyor rollers 24, 30.

By adjusting the unlocking levers 56 into their unlocking position 56', illustrated by dash-dotted lines, their free arms 60 press the latching levers 50 into their unlocking position 50', illustrated by dash-dotted lines, so that the upper part 14 can be pivoted into its folded-up position illustrated in FIG. 2. In the process, the free arms 60 of the unlocking levers 56 come out of engagement with the latching levers 50 which, under the force of the locking springs 54, return to their original position. In the folded-up position of the upper part 14, the recording medium supply roll 64 can be put into the holding trough 62, and the recording medium 66 can be placed on the driven rollers 38, 40.

If the upper part 14 is moved into its folded-down position, shown in FIG. 1, then the locking pins 44 slide along on the insertion bevels 52 until they latch into the claws 46. In the process, the recording medium 66 is clamped into the pairs of conveyor rollers 24, 30. If their drive motor is briefly energized, the recording medium 66 is additionally tautened upstream of the print backing support 36, and the printer 10 is ready to print.

It can be gathered from the plan view in FIG. 3 that the area between the side cheeks 13 is divided up into three sections: an acceleration area 68, a printing area 70 and a parking area 72. The print backing support 36 extends over the entire printing area 70. In the parking area, which adjoins the printing area 70 on the right in FIG. 3, there is arranged a docking station 74, as it is called, which comprises a covering cap 76 that prevents the ink jet print head 18 drying out, and a wiping lip 78. The docking station 74 can also additionally comprise a suction device for cleaning the ink nozzles of the ink jet print head 18. Docking stations for ink jet printers are generally known. A specific description of their construction and their mode of action is therefore superfluous. The acceleration area 68 is needed if printing is to be carried out in both conveying directions of the ink jet print head 18 and, at the same time, with a constant print quality. When the ink jet print head 18 starts from the side cheek 13 on the left in FIG. 3, it has already reached its intended speed when it enters the printing area 70.

Within the parking area 72, a first arm 80 of a blocking lever 82 that is acted on in the direction of the upper part 14 by the force of a third compression spring 86 projects into the displacement path of the ink jet print head 18. A second arm 84 of the blocking lever 82 engages behind the latching lever 50 (on the right in the figure) , so that the latter is blocked and the upper part 14 cannot be pivoted out of its printing position. The blocking position of the blocking lever 82 is illustrated. dash-dotted. If, however, the ink jet print head 18 is moved into its parking position, illustrated in FIG. 3, it displaces the blocking lever 82 to the right into its release position, illustrated by continuous lines, the right-hand latching lever 50 is released and the upper part 14 can be pivoted out of the printing position.

In addition, a print head blocking lever 88 is mounted such that it can be displaced vertically in the lower part 12 of the printer 10. Said, lever has a first arm 90 which projects into the displacement path of the ink jet print head 18. A second arm 92 of the print head blocking lever 88 projects into the pivoting path of the upper part 14. The print head blocking lever 88 can be displaced between a blocking position, with its first arm 90 projecting into the displacement path of the ink jet print head 18 (illustrated dash-dotted in FIG. 1) and a position which clears the displacement path (illustrated, by continuous lines in FIG. 1). It is prestressed in the direction of its blocking position by the force of a fourth compression spring 94. The print head blocking lever 88 is arranged with respect to the displacement path of the ink jet print head 18 such that the latter can be held firmly in the parking position. As long as the upper part 14 is in its printing position, the print head blocking lever 88 is held in its release position, and the ink jet print head 18 can be displaced as desired. If the upper part 14 is pivoted out of the printing position, the print head blocking lever 88 is displaced into its blocking position, driven by the fourth compression spring 94.

The blocking lever 82 and the print head blocking lever 88 act together in such a way that, firstly, the upper part 14 can be moved out of its printing position only when the ink jet print head 18 is located in the parking area 72, and that, secondly, the ink jet print head 18 can be moved out of the parking area 72 only when the upper part 14 is located in its printing position. As a result, reliable protection for the ink jet print head 18 against accidental contact is achieved.

What is claimed is:

1. A printing device (10) comprising a lower part (12) and an upper part (14) that is attached to said lower part (12), an imaging device (18) and a holding trough (62) for a recording medium supply roll (64) being arranged in the lower part (12), and a conveying device for a recording medium (66), and a print backing support (36) extending over a printing area (70) and spatially associated with the imaging device (18) being arranged in the upper part (14), the upper part (14) having two side walls (42) which laterally enclose a recording medium supply roll (64) put into the holding trough (62), and the upper part (14) being capable of pivoting about a pivot axis (16), between an opening position that opens the holding trough (62) and a printing position, in which the print backing support (36) is opposite the imaging device (18), characterized in that the imaging device is a serial-character or serial-column print head (18) which can be displaced in the direction of a line of print, the print backing support (36) is planar in the printing area (70) of the print head (18), the conveying device comprises a first pair of conveyor rollers (24) that are aligned parallel to the printing area (70) and can be driven by a motor, the first pair of conveyor rollers (24), as viewed in the conveying direction of the recording medium (66), being arranged upstream of the print backing support (36), and a tautening device for the recording medium (66), the tautening device comprising a second pair of conveyor rollers (30) driven at the same time as the first pair of conveyor rollers (24) arranged downstream of the print backing support (36), the second pair of conveyor rollers (30) being driven at a slightly greater conveying speed than the first pair of conveyor rollers (24) and having a coefficient of friction that is lower than the first pair of conveying rollers (24), and in that, as viewed in the direction of a line of print, a parking area (72) for the print head is arranged beside the printing area (70).

2. The printing device as claimed in claim 1, characterized in that the print head (18) can print a number of lines of print simultaneously.

3. The printing device as claimed in claim 1, characterized in that the print head is an ink jet print head (18).

4. The printing device as claimed in claim 1, characterized in that the pivot axis (16) is located at the same height as a center line (25) which passes through the first backing roller (22) and the first driven roller (38), or underneath said line.

5. The printing device as claimed claim 1, characterized in that at least one latching lever (50) is pivotably mounted on the lower part (12) and, on the side wall (42) of the upper part (14) adjacent to the latching lever (50), there is arranged a first locking element designed as a locking pin (44) or as a claw and, on the latching lever (50), there is arranged a second locking element (46) which is designed to be complementary the first locking element.

6. The printing device as claimed in claim 5, characterized in that on the side wall (42) that is adjacent to the latching lever (50), on that side of the upper part (14) that is remote from the pivot axis (16), a two-armed unlocking lever (56) is pivotably mounted, whose one arm (60) is intended to engage on the at least one latching lever (50) with the effect of unlocking the complementary locking elements (44, 46).

7. The printing device as claimed in claim 6, characterized in that a latching lever (50) is arranged on both sides of the lower part (12), and an unlocking lever (56) is arranged on both sides of the upper part (14), in that the unlocking levers (56) are connected to each other in a U shape, and in that the U-shaped unlocking lever arrangement (56, 58, 56) engages over the upper part (14) and can be pivoted about a pivot axis (57) which passes perpendicularly through the side walls (42) of the upper part (14).

8. The printing device as claimed in claim 5, characterized in that the at least one latching lever (50) can be moved into the unlocking position only when the print head (18) is located in the parking area (72) or the acceleration area (68).

9. The printing device as claimed in claim 8, characterized in that the print head (18) is blocked in the parking area (72) or the acceleration area (68) if the upper part (14) is outside the printing position.

10. The printing device as claimed in claim 1, characterized in that, at least on one side of the printing area (70), an acceleration area (68) for the print head (18) adjoins said printing area (70).

11. The printing device as claimed in claim 1, characterized in that at least the backing roller (28) of the first pair of conveyor rollers (24) or of the second pair of conveyor rollers (30) has a surface structure that cannot be wetted by printing ink and/or consists of a material that cannot be wetted by printing ink.

12. A printing device (10) comprising a lower part (12) and an upper part (14) that is attached to said lower part (12), an imaging device (18) and a holding trough (62) for a recording medium supply roll (64) being arranged in the lower part (12), and a conveying device for a recording medium (66), and a print backing support (36) extending over a printing area (70) and spatially associated with the imaging device. (18) being arranged in the upper part (14), the upper part (14) having two side walls (42) which laterally enclose a recording medium supply roll (64) put into the holding trough (62), and the upper part (14) being capable of pivoting about a pivot axis (16), between an opening position that opens the holding trough (62) and a printing position, in which the print backing support (36) is opposite the imaging device (18), characterized in that the imaging device is a serial-character or serial-column print head (18) which can be displaced in the direction of a line of print, the print backing support (36) is planar in the printing area (70) of the print head (18), the conveying device comprises a first pair of conveyor rollers (24) that, are aligned parallel to the printing area (70) and can be driven by a motor, the first pair of conveyor rollers (24), as viewed in the conveying direction of the recording medium (66), being arranged upstream of the print backing support (36), and a tautening device for the recording medium (66), the tautening device comprising a second pair of conveyor rollers (30) driven at the same time as the first pair of conveyor rollers (24) arranged downstream of the print backing support (36), the second pair of conveyor rollers (30) being driven at a slightly greater conveying speed than the first pair of conveyor rollers (24) and having a coefficient of friction that is lower than the first pair of conveying rollers (24), and in that, as viewed in the direction of a line of print, a parking area (72) for the print head is arranged beside the printing area (70), the first pair of conveyor rollers (24) or else the first pair of conveyor rollers (24) and the tautening device being formed by a driven roller (38; 40) which is mounted on the upper part (14) and acts on the rear of the recording medium (66), and a backing roller (22; 28) which is mounted on the lower part (12), being acted on in the direction of the driven roller (38; 40) by the force of a spring (32; 34), acts on the recording side of the recording medium (66) and runs freely.

* * * * *